United States Patent [19]

Sharpless et al.

[11] Patent Number: 4,819,879

[45] Date of Patent: Apr. 11, 1989

[54] PARTICLE SPRAY GUN

[75] Inventors: John Sharpless, Oberlin; Alan J. Knobbe, Lorain; Kenneth A. White, Sheffield Lake; Gerald W. Crum, Elyria, all of Ohio

[73] Assignee: Nordson Corporation, Amherst, Ohio

[21] Appl. No.: 72,780

[22] Filed: Jul. 13, 1987

Related U.S. Application Data

[63] Continuation-in-part of Ser. No. 791,352, Oct. 25, 1985, abandoned, which is a continuation-in-part of Ser. No. 724,392, Apr. 18, 1985, abandoned.

[51] Int. Cl.[4] ..... B05B 5/02

[52] U.S. Cl. ..... 239/691; 239/698; 239/707; 239/708

[58] Field of Search ..... 239/690, 697, 698, 704, 239/706–708, 691; 361/226, 227, 228

[56] References Cited

U.S. PATENT DOCUMENTS

| | | | |
|---|---|---|---|
| 2,352,252 | 6/1944 | Canetta | 239/706 X |
| 2,657,339 | 10/1953 | Hampe | 239/704 X |
| 3,086,711 | 4/1963 | Point . | |
| 3,327,948 | 6/1967 | Gignoux . | |
| 3,540,653 | 11/1970 | Fabre . | |
| 3,985,297 | 10/1976 | Itoh | 239/15 |
| 4,027,050 | 5/1977 | Haig . | |
| 4,163,520 | 8/1979 | Garcin et al. . | |
| 4,735,360 | 4/1988 | Kirchner et al. . | |

FOREIGN PATENT DOCUMENTS

| | | | |
|---|---|---|---|
| 0102735 | 3/1984 | European Pat. Off. . | |
| 0123964 | 7/1984 | European Pat. Off. . | |
| 203694 | 12/1986 | European Pat. Off. | 239/691 |
| 1554631 | 5/1967 | France | 239/706 |
| 92033 | 9/1968 | France . | |
| 2319425 | 2/1977 | France . | |
| WO84/03846 | 10/1984 | PCT Int'l Appl. . | |
| 1406358 | 9/1975 | United Kingdom | 239/707 |

OTHER PUBLICATIONS

Control-A-Cloud Literature, Finishing Show, Cincinnati, OH, Fall 1987.

*Primary Examiner*—Andres Kashnikow
*Assistant Examiner*—Patrick N. Burkhart
*Attorney, Agent, or Firm*—Wood, Herron & Evans

[57] ABSTRACT

An electrostatic particle spray gun having, in one preferred embodiment, a conical deflector of insulative material mounted in the nozzle in the particle path for forming a conical particle spray pattern. A resistive sheet connected to a high voltage electrostatic supply is sandwiched between the forward and rearward ends of the deflector, leaving only the perimeter of the sheet exposed at the peripheral region of the conical deflector. The perimeter of the resistive sheet functions as a multi-point circular electrode for charging the particles such that improved coating transfer efficiencies are achieved. Also, because of the resistive nature of the resistive sheet, the sheet constitutes a resistor in the electrical current path between the center of the sheet where it connects to a high voltage terminal and the circular periphery of the sheet which serves as the multiple point charging electrode, thereby minimizing unsafe electrical discharges should the electrode inadvertently approach a grounded object.

82 Claims, 4 Drawing Sheets

PARTICLE SPRAY GUN

CROSS-REFERENCE TO RELATED APPLICATION

This application is a continuation-in-part of pending C.I.P. application Ser. No. 791,352, filed Oct. 25, 1985 (now abandoned), which is a continuation-in-part of Ser. No. 724,392, filed Apr. 18, 1985 now abandoned.

This invention relates to particle spray equipment and more particularly to an improved particle spray gun for electrostatically applying coating particles to an article to be coated.

The subject matter of this application is related to copending application Ser. No. 602,974, filed Apr. 23, 1984 entitled Electrostatic Spray Coating System, in the names of Donald R. Hastings and John Sharpless, assigned to the assignee of the present application (now U.S. Pat. No. 4,576,827).

BACKGROUND OF THE INVENTION

Coating applied electrostatically to an object to be coated can be either in the form of electrostatically charged solid particles, i.e., powder, or electrostatically charged liquid particles which have been atomized using a variety of well known techniques or principles, including air impingement atomization, airless or hydrostatic pressure atomization, and/or electrostatic atomization. This invention is useful with both liquid and powder spray coating applications.

In the application of solid particulate coatings, such as powdered resins, in industrial finishing applications, the particulate or powder is commonly conveyed to a spray device, often termed a "gun", by air under pressure and is then sprayed from an opening in the forward end, or nozzle, of the gun in the form of a powder-entrained air stream which is projected along a path from the gun toward the object to be coated. In the process of spraying the coating particles from the gun, an electrical charge is preferably imparted to the particles by an electrode maintained at a high voltage which is mounted to the gun nozzle proximate to the path of the powder coating stream. The charged particles are then electrostatically attracted toward the object to be coated which is held at electrical ground potential, enhancing the efficiency with which charged particles sprayed from the gun are deposited on the target article. After the article is coated, it is generally conveyed through an oven where the powder coating material is heated and fused onto the surface of the article to permanently bond it thereto.

Electrostatic powder spray guns typically include a mechanical powder deflector mounted at the nozzle end of the gun. In one preferred form the deflector is in the shape of a cone and is disposed axially in the flow path of the powder being sprayed from the gun, deflecting the powder into a conical spray pattern. That is, the deflector is impacted by the powder coating material being sprayed from the gun in the nozzle region and directs the powder radially outwardly to form a conical spray pattern.

Electrostatic liquid spray gun systems customarily include a source of pressurized liquid which conveys the liquid coating to the gun via a hose where it is emitted from the nozzle in a stream of atomized particles. Atomization can be produced by impingement of the liquid stream with air in the region of the nozzle, which is known as air atomization. Alternatively, the liquid coating can be highly pressurized such that upon exit from the nozzle atomization results, which is termed hydrostatic or airless atomization. In still other systems, the liquid is subjected to electrostatic forces which effectively atomize the liquid.

One of the objectives in the design of an electrostatic spray gun, either liquid or powder, is to maximize the efficiency with which charged coating particles sprayed from the gun are deposited on the article being coated. This is called the "transfer efficiency". It is generally believed by those skilled in the art that transfer efficiency can be increased by increasing the charge on the particles and/or by increasing the strength of the electrostatic field between the gun and the article being coated.

SUMMARY OF INVENTION

Accordingly, it has been an objective of this invention to construct an electrostatic spray gun which will both increase the charge on the particles and the strength of the electrostatic field between gun and article being coated, and thereby provide improved powder coating transfer efficiency. This objective has been accomplished by providing a particle spray device, which has an opening from which a stream of particles is sprayed in a forward path toward an object to be electrostatically coated, with a multi-point electrode comprising a substantial number of closely spaced electrode elements located proximate the opening through which the particle stream passes. Energization of the multi-point electrode from a high voltage electrostatic supply results in the creation of a plurality of corona charging points proximate the particle stream, thereby enhancing coating transfer efficiency.

In one preferred embodiment of a powder spray gun, a deflector is provided in the nozzle powder stream path which is constructed of electrically nonconductive material, and which has (a) a rear surface upon which the forwardly directed powder stream impinges and as a result thereof becomes deflected into the desired stream configuration, (b) a front surface facing the forward direction, and (c) a substantial number of electrode elements circumferentially spaced around the perimeter of the deflector which are connected to a high voltage source via associated resistive paths incorporated in the deflector. These electrode elements collectively function as a multi-point electrode to provide a plurality of corona charging points when the electrode is energized.

In the one preferred embodiment described above, the multi-point electrode is in the form of a fibrous resistive sheet constructed from a material such as silicon carbide, which is incorporated in the deflector between the front and rear surfaces thereof to define as its periphery, which is proximate to the deflector periphery, a large number of radially arranged electrode elements which establish a plurality of corona charging points past which the deflected powder stream passes to be electrostatically charged as the powder particles are sprayed from the gun. In this embodiment, in which the substantial number of radially arranged electrode elements circumferentially spaced around the deflector periphery function to establish a plurality of corona charging points, the resistive sheet located radially inwardly of the electrode elements functions as resistive paths incorporated in the deflector through which the electrode elements are energized from a suitable high voltage source. While a silicon carbide material is preferred for use as the resistive sheet in this embodiment, other fibrous resistive materials may also be suitable.

An important advantage of the foregoing embodiment of this invention is that the peripheral edge of the silicon carbide sheet includes the ends of the many silicon carbide fibers forming the resistive sheet and these fiber ends form a multitude of radially arranged electrode elements which establish a plurality of corona charging points which charge the powder particles as they are sprayed. This deflector structure is believed to both increase the charge transferred to the powder particles, and to increase the strength of the electrostatic field between the gun and the workpiece, to enhance coating transfer efficiency. Another advantage is that the deflector structure, particularly the resistive paths and plural circumferentially-arranged electrode elements, is relatively inexpensive, easy to manufacture, and durable. It is also readily replaceable should such become necessary. These attributes enhance the attractiveness of the gun from a commercial standpoint.

In the foregoing form of the invention, the silicon carbide sheet has a centrally disposed high voltage terminal region remote from the edge thereof for establishing an electrically resistive current flow path through the sheet between the central terminal region whereat high voltage is supplied and the peripheral edge whereat corona charging of the powder particles occurs from the many silicon carbide fiber ends. This resistive path constitutes a relatively large resistor and functions to minimize ignition hazards due to inadvertent discharge of electrical energy capacitively stored in the spray coating system of which the gun is a major component.

In another preferred embodiment of this invention, the circumferentially spaced electrode elements around the deflector perimeter are in the form of discrete, fixed electrodes in the form of electrically conductive needles or wires which project radially outwardly from the perimeter of the deflector. Each of the discrete electrodes is connected to a high voltage source via a discrete resistor embodied in the deflector. If desired, the radially disposed electrodes can be made flush with the deflector periphery in lieu of projecting outwardly therefrom, thereby reducing the likelihood of electrode damage.

In accordance with a still further, and also preferred, embodiment of the invention, the deflector is provided with a relatively narrow silicon carbide ribbon or thread, which function as circumferentially arranged electrode elements, via discrete resistors embodied in the deflector which are radially disposed and circumferentially spaced within the deflector.

In the embodiments of the invention utilizing discrete resistors embodied in the deflector to interconnect the high voltage source and the circumferentially spaced electrode elements on the deflector periphery, the resistors function to minimize ignition hazards due to inadvertent electrical energy discharges, thereby enhancing the safety of the gun.

In accordance with a further aspect of the invention which can be advantageously incorporated into each of the foregoing embodiments, the nozzle located at the forward end of the nonconductive gun barrel is provided with an electrostatic shield. The shield is disposed outwardly and rearwardly of the perimeter of the deflector whereat the corona charging points are located which electrostatically charge the deflected powder stream as it passes through the annular opening between the nozzle and the conically-shaped deflector which is axially disposed in the powder flow path. In a preferred form, the electrostatic shield is formed by flaring the end of the nozzle in the region surrounding the forward end of the conical deflector, particularly the perimeter thereof, from which extend the corona charging points. In practice, the electrostatic shield has been found to significantly improve the transfer efficiency when compared to a similarly-constructed spray device which does not have the electrostatic shield.

By way of background, and as an aid to understanding how the electrostatic shield of this invention enhances transfer efficiency, in a typical electrostatic spray gun of the type having an electrically-grounded handle or mounting member, the corona zone proximate the periphery of the deflector is approximately midway between the grounded gun handle or mounting member which is located rearwardly thereof and the electrically-grounded object being coated which is located forwardly thereof. By way of example, the distance between the grounded object being coated and the corona charging zone is approximately ten inches, which is approximately the same as the distance between the corona zone at the gun nozzle and the rearwardly-located electrically-grounded gun handle or mounting member. Without the electrostatic shielding outboard and behind the corona charging zone proximate the periphery of the deflector, the electrically-charged coating particles issuing from the gun nozzle are as close to the grounded article being coated as is the grounded gun handle or mounting member, with the result that some charged particles are electrostatically attracted to the grounded gun handle or mounting member, impairing the efficiency of the coating transfer process.

In addition, because the gun handle, or mounting hardware, provides an attraction to some of the charged particles, a corona current path is set up between the deflector and the grounded handle which causes the available electrical energy for charging at the deflector to be reduced by parasitic discharge. This reduction in available charging energy at the deflector, results in a corresponding reduction n transfer efficiency. Therefore, by inclusion of the electrostatic shield of this invention, the effect of the electrically-grounded gun handle or mount in terms of attracting electrostatically-charged particles and of providing a parasitic current leakage path is substantially reduced, with the result that transfer efficiency is significantly increased. This is a substantial improvement in transfer efficiency in comparison to the result if the electrostatic shielding in the nozzle surrounding the deflector periphery is omitted.

The electrostatic shield can be used advantageously with guns, manual or automatic, which are designed to spray coating particles of either the atomized liquid or powder type.

In accordance with still other embodiments of the invention, the multi-point electrode is in the form of a disc with a sawtooth perimeter. The entire disc may be fabricated of resistive, semiconductive or conductive material. Alternatively, the disc may be of a composite construction with an inner circular section, and an outer annular section with teeth at the periphery. The inner and/or outer sections may be conductive, resistive, or semiconductive solid sheet, fibrous or mesh material. In lieu of the inner circular section, a series of electrical wires connected to the annular section may be used to transport high voltage to the toothed periphery thereof.

In another form, the multi-point electrode may be a disc-shaped mesh of conductive, semiconductive, or resistive wire, or nonconductive wire having a cladding of conductive, semiconductive, or resistive material.

In another embodiment, useful in a powder gun having a deflector, the deflector is fabricated of injection molded material containing silicon carbide or other resistive fibers, particularly at the perimeter thereof, which function as multi-point electrodes. The deflector may also include semiconductive, resistive, or conductive material to transport the high voltage to the silicon carbide fibers at the deflector perimeter. Instead of silicon carbide fibers at the periphery of the deflector, a multipoint electrode could be provided by mounting a large number of electrodes in the deflector perimeter to function as multiple electrodes.

In any of the aforementioned embodiments, it is desirable to provide resistance sufficiently close to the multiple electrodes and in sufficient amount to avoid unsafe electrical discharges should electrical energy capacitively stored in the gun suddenly become discharged by the approach of a grounded article to the multipoint electrode.

The multi-point electrode aspect of this invention, while described in connection with a powder gun having a deflector, is also useful in atomized liquid spray devices. In such devices the multi-point electrode is mounted in the nozzle region proximate the path of atomized liquid particles being emitted from the nozzle toward the article to be coated in much the same manner that the multi-point electrode is mounted in the deflector of a powder gun proximate the path of the emitted powder particles.

In accordance with certain other embodiments of the invention, the multi-point electrode is in the form of a disk having circumferentially-spaced, pie-shaped resistive sheet electrode elements separated by pie-shaped insulative sheet sectors disposed therebetween. In an alternative multi-point electrode of the multi-sector type, the circumferentially-spaced resistive sheet electrodes have a rectangular shape with pie-shaped insulating sectors disposed therebetween.

These and other objectives, advantages, and features of the invention will become more readily apparent from a detailed description of the invention taken in conjunction with the drawings in which.

Figure 1:
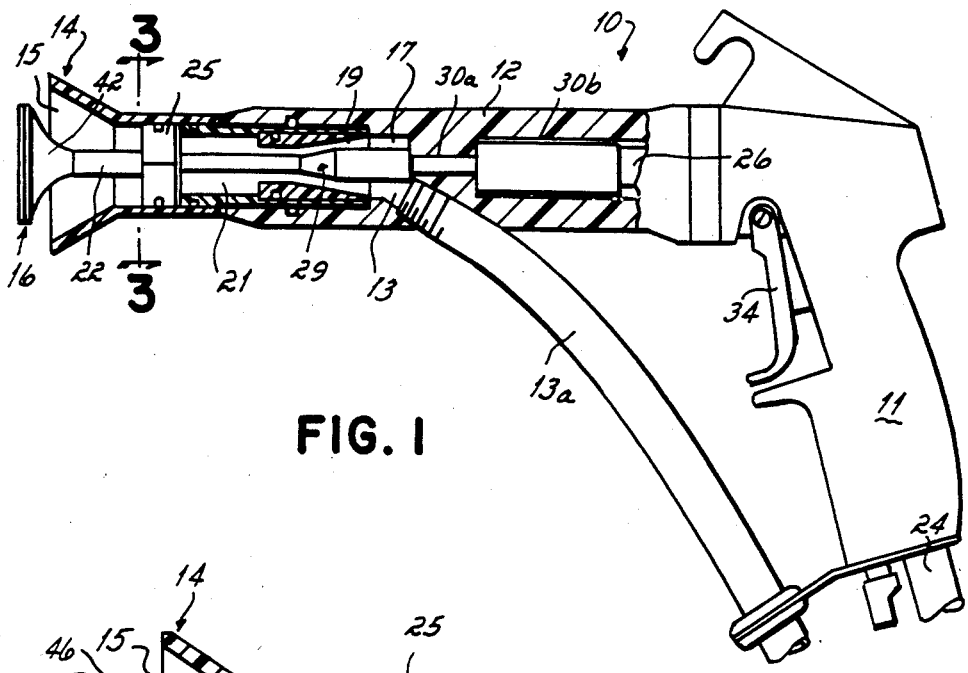
FIG. 1 is a side elevational view, partly in cross section, depicting the principal components of one embodiment of an electrostatic powder spray gun incorporating the invention.

With reference to the figures, one preferred form of electrostatic spray gun incorporating the present invention is depicted. In the preferred embodiment the spray device 10 is in the form of a gun having an electrically grounded conductive handle 11 and a nonconductive or insulative barrel 12 which at its forward end terminates in a flared nozzle 14 having a central flared opening 15 from which projects a combined powder deflector and electrode charging assembly 16. Except for the assembly 16, the preferred embodiment of the spray gun can be constructed in accordance with the teachings of pending U.S. patent application Ser. No. 681,501, filed Dec. 13, 1984, entitled "Improved Powder Spray Gun", in the name of Thomas E. Hollstein, David E. O'Ryan, and Joseph C. Waryu, assigned to the assignee of the present application. The entire disclosure of application Ser. No. 681,501 is incorporated herein by reference.

The barrel 12 includes an internal powder entry chamber 17 which at its rearward end communicates with a powder-entrained pressurized air supply hose **13*a* via a port 13 in the barrel wall. The internal powder entry chamber 17 at its forward end communicates with the nozzle opening 15 via a tapered bore 19 and intermediate chamber 21. A nonconductive mounting stub 22 for the deflector and electrode assembly 16 extends axially and forwardly from a nonconductive spider 25 located within the intermediate chamber 21. Extending axially and rearwardly from the spider 25 is an electrically insulated conductive path 29 incorporating a conductor 76 (to be described) which extends through a stepped diameter bore 30*a* and 30*b* where it makes an appropriate connection with an insulated high voltage supply cable 26 which passes through the handle 11 exiting the butt thereof at 24** where it connects to a remote high voltage electrostatic power supply (not shown).

The handle 11 is provided with a movable trigger 34 which when activated supplies pressurized powder-entrained air to the powder entry chamber 17 via hose 13*a*. Trigger 34 also energizes the remote high voltage supply to provide high voltage electrostatic power to an electrical conductor 70 (later described) which is axially disposed within the powder deflector 16. The conductor 70 is connected to the high voltage supply by high voltage cable 24, 26 and the electrically insulated conductive path 29 which passes through the mounting stub 22 and spider 25. The powder-entrained air passes under pressure from the entry chamber 17 successively through the tapered bore 19 and intermediate chamber 21 to the flared nozzle opening 15 whereat it is diverted into a conical path and electrostatically charged by the electrode, to be described, incorporated in the powder deflector and electrode charging assembly 16. The powder exits the nozzle opening in a generally conical pattern of electrostatically charged particles for impingement upon an electrically grounded article (not shown) to be coated.

Figure 2:
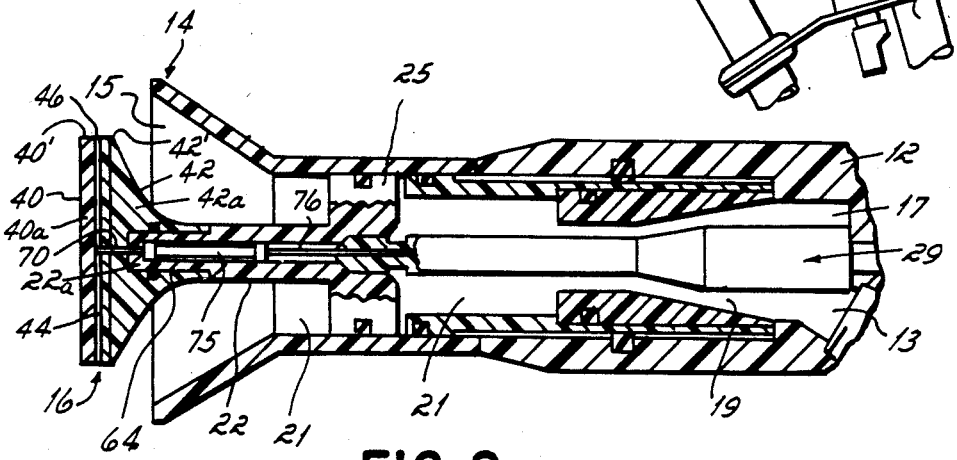
FIG. 2 is an enlarged side elevational view in cross section, showing the forward end of the powder gun of FIG. 1, including the nozzle, deflector, and powder-charging electrode.
Figure 3:
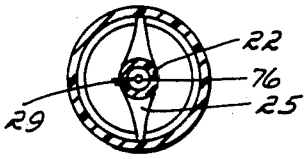
FIG. 3 is a cross sectional view along line 3—3 of FIG. 1.

The powder deflector and electrode charging assembly 16, considered in more detail in connection with FIG. 2, is generally conical in shape having a circular flat front surface 40 and a conical rear surface 42. Front surface 40 could also be convex or concave, if desired. A resistive sheet electrode in the form of a circular wafer or disc 44 is located in a boundary region between the front and rear surfaces 40 and 42. The edge 46 of the resistive electrode sheet or disc 44 is preferably flush with the edges 40' and 42' of the front and rear surfaces 40 and 42. In a preferred form of the invention, the powder deflector and electrode charging assembly 16 is a composite or sandwich assembly which includes the intermediate resistive electrode disc 44, a circular insulating disc 40*a* having a diameter equal to that of the resistive electrode disc 44, and a conical insulating section 42*a* the rearward surface of which constitutes the powder deflecting conical surface 42. The conical section 42*a*, resistive electrode disc 44, and disc 40*a* can be permanently assembled to form an integral unit utilizing commercially available adhesives. Alternatively, the resistive sheet could be molded into the deflector.

In a preferred form of the invention the resistive electrode disc 44 is fabricated of nonwoven silicon carbide fabric embodying randomly oriented silicon carbide fibers or filaments in a resin matrix. The silicon carbide fibers or filaments from which the fabric is made have the physical and electrical characteristics of Nicalon fiber of the general type disclosed in U.S. Pat. No. 4,100,233 and commercially available from Nippon Carbon Co., Ltd., Tokyo, Japan, and Dow Corning, Midland, Mich. In a preferred embodiment the silicon carbide fibers are heat treated to provide a specific resistivity of $1\times10^3$ ohm-cm., and a fiber diameter in the approximate range of 10–15 microns. The entire disclosure of U.S. Pat. No. 4,100,233, as well as the following publications of Nippon Carbon Co., Ltd., Tokyo, Japan, available from Dow Corning, Midland, Mich., are incorporated herein by reference:

Nicalon Silicon Carbide Fiber, 12 pages; Price Listing Effective 1-1-84, Nicalon Silicon Carbide Fiber Products Distributed by Dow Corning Corporation, 2 pages; and Industrialization of Silicon Carbide Fiber and Its Applications, by Jun-Ishi Tanaka, Executive Director, Nippon Carbon Co., Ltd., 11 pages.

Nicalon continuous silicon carbide fiber, in one commercially available form, is physically characterized as follows:

Filament Diameter: 10–15 microns,
Cross Section: round
Density: 0.093 pounds/inch$^3$ (2.55 g/cm$^3$),
Tensile Strength: 360–470- ksi (250–300 kg/mm$^2$),
Tensile Modulus: $26–29\times10^3$ ksi ($18–20\times10^3$ kg/mm$^2$), and
Coefficient of Thermal Expansion (parallel to fiber): $3.1\times10^{-6}$/°C.

The specific resistivity of Nicalon silicon carbide fiber which is uniform throughout the fiber and independent of fiber flexure, can be varied by heat treating the fiber at different temperatures subsequent to spinning. The variation in specific resistivity as a function of heat treating temperature can vary by a factor of approximately $10^4$ from approximately $10^2$ ohm-cm to $10^6$ ohm-cm.

The Nicalon continuous silicon carbide fibers can be formed into woven fabric, as well as nonwoven fabric of random fiber orientation. In addition, the resistive silicon carbide disc 44 can be fabricated of resin impregnated Nicalon fabric composite, glass Nicalon fabric composite, and/or Nicalon fibers in a ceramic matrix.

The insulative front disc 40*a* and insulative conical deflector 42*a* can be fabricated of a variety of nonconductive materials including glass-filled Teflon plastic, Delrin plastic, and the like.

The deflector/electrode assembly 16 is mounted to the stub 22 by the axial engagement of a reduced diameter section 22*a* at the forward end of the mounting stub 22 and a blind hole or bore 64 formed in the rear central portion of the conical deflector 42*a*. The bore 64 and reduced diameter end 22*a* of the stub 22 are dimensioned to provide a snug sliding fit therebetween.

As noted previously, electrostatic energy is transmitted from a remote power supply (not shown) to the resistive charging disc 44 via the cable 24, 26 and the electrically insulated resistorized conductive path 29. Conductive path 29 includes an electrical conductor (or electrode) 70 which projects axially from the end of the mounting stub 22 into a suitably provided axial passage in the conical deflector section 42*a* to establish electrical contact with the resistive disc 44. The conductor 70 is connected to the electrically conductive core of the cable 26 via a resistor 75 and electrical conductor 76 which constitute further elements of conductive path 29, and which are in electrical series circuit arrangement between the conductor 70 and the conductive core of the high voltage cable 26.

In operation, when the trigger 34 is activated, powder-entrained pressurized air is introduced into the internal powder entry chamber 17 via the hose 13*a* whereupon it flows through the tapered bore 19 into the intermediate chamber 21 where it passes through the spider 25 and impinges on the rear surface 42 of the conical deflector 42*a* which causes the path of the powder to deflect and form a conical path as it exits the flared opening 15 of the nozzle 14 toward the article or target substrate to be coated (not shown). Activation of the trigger 34 also energizes a remote power supply (not shown) to cause high voltage electrostatic energy to be supplied to the resistive charging disc 44 via the electrical path previously described. With the resistive charging disc 44 maintained at a high electrostatic voltage, such as 90 Kv, a corona discharge is produced at the multitude of resistive material fiber ends 46*a* located around the perimeter 46 of the resistive charging disc 44, causing electrostatic charge to be imparted to the stream of powder as it exits the flared opening 15 of nozzle 14 subsequent to deflection by the rear conical deflecting surface 42.

Experience has shown that higher coating transfer efficiencies can be achieved with the electrostatic spray coating gun of this invention. In practice, the number of corona points, as well as their precise location around the periphery 46 of the resistive charging disc 44, is somewhat variable. At no load voltages of 90 Kv with a charging disc 44 having a diameter of approximately 1½ inches and a thickness of approximately 0.65 mm, anywhere between three and eight corona points have been observed to simultaneously occur at peripheral locations which are continuously changing on a more or less random basis.

Contributing in a material manner to transfer efficiency enhancement provided by the preferred embodiment depicted in FIGS. 1–4, as well as the other embodiments herein described in more detail hereafter, is the flared configuration of the nozzle 14 relative to the corona charging zone located proximate the edge 46 of the resistive electrode sheet 44. More particularly, the nonconductive, flared outer portion of the nozzle 14, which is located outwardly and rearwardly of the corona charging zone proximate perimeter 46, functions as an electrostatic shield which effectively shields electrostatically-charged coating particles at the exit end of the nozzle from the electrically grounded handle 11, reducing the tendency of a parasitic leakage current to be set up between the deflector and the handle 11. Were the shielding omitted, the grounded handle 11 would tend to electrostatically attract the charged coating particles, setting up an undesirable leakage current, and thereby reducing the charging energy available at the deflector and the transfer efficiency. This is particularly true in view of the fact that the grounded handle is typically located at approximately the same distance from the corona charging zone, albeit rearwardly thereof, as the object being coated which is electrically grounded and located forwardly of the gun nozzle. Tests have shown that removal of the portion of the flared nozzle 14 located radially beyond the perimeter 46 of the deflector, which in turn eliminates the electrostatic shielding between the deflector perimeter and the electrically-grounded handle 11, significantly reduces the transfer efficiency.

While in the embodiment shown in FIGS. 1–4, the forward extremity or lip 14*a* of the nozzle 14 is located slightly rearwardly relative to the edge 46 of the resistive electrode sheet 44, the position of the lip 14*a* relative to the electrode sheet edge 46 can be varied, such as by locating the flared nozzle mouth or lip 14*a* radially opposite the electrode sheet edge 46*a* or forwardly thereof (leftwardly as viewed in FIG. 2). Regardless of the exact location of flared nozzle mouth or lip 14*a* relative to the edge 46 of the resistive sheet 44, at least a portion of the nonconductive flared nozzle 14*a* must be located radially outwardly and rearwardly of the corona charging zone proximate edge 46 of resistive sheet 44 such that electrostatic shielding is provided between the electrostatic charging corona zone and the electrically-grounded handle 11.

In the preferred embodiment, the electrostatic shield is described in connection with its use in a powder gun. As noted, it can also be used to advantage in a liquid coating gun wherein charged atomized paint particles are proximate the gun nozzle.

Because of the resistive nature of the charging disc 44, the electrostatic spray gun of this invention has been found to prevent ignition when subjected to standard ignition tests performed by Nordson Corporation, assignee of the present application. In practice, the disc 44 provides a resistance of 1.0 Megohm–1.5 Megohm when measured between the center which contacts conductor 70 and the periphery 46.

The composite or sandwich construction of the combined powder deflector and electrode charging assembly 16 is extremely durable and inexpensive, and yet is very effective both as a deflector and as an electrostatic charging electrode configuration.

If desired, the charging disc can be mounted on the front surface 40, such that it faces forward and is exposed, rather than be sandwiched between members 40*a* and 42*a*. However, the sandwich construction is preferred.

In the embodiment of FIGS. 1–4, as described, the deflector 16 is principally fabricated of insulative sections 40*a* and 42*a*. If desired, the deflector could be fabricated of resistive or semiconductive material, or possibly even conductive material, providing the multi-point electrode is located at the periphery thereof. With such a construction, suitable resistance is preferably provided in series with the multi-point electrode to avoid unsafe electrical discharges of electrical energy stored in the gun should the multi-point electrode be accidentally grounded.

Figure 4:
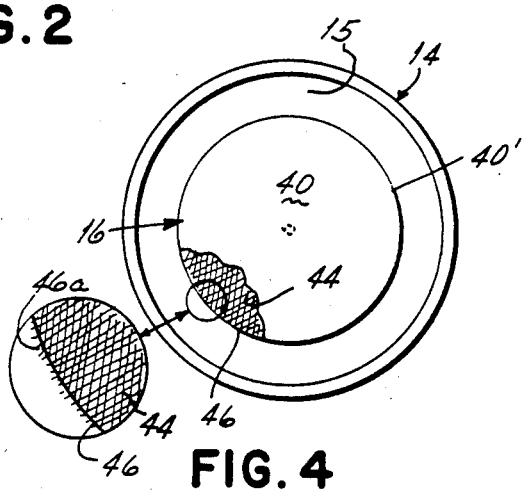
FIG. 4 is a front elevational view, of the nozzle of the gun of FIG. 1, depicting the deflector partially cutaway to show the resistive fibrous sheet.
Figure 5:
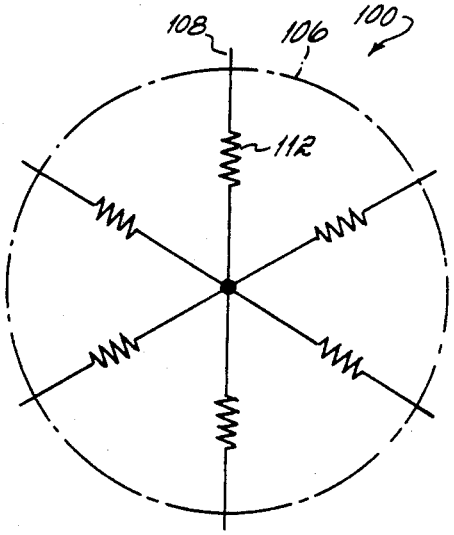
FIG. 5 is a front elevational view of a deflector, incorporating radially outwardly projecting electrodes and discrete resistors, of another embodiment of the invention.
Figure 6:
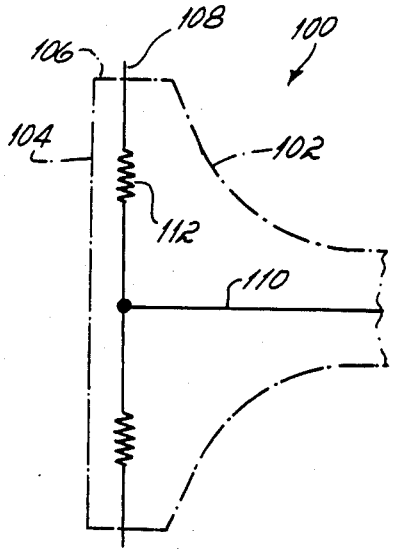
FIG. 6 is a side elevational view of the deflector of FIG. 5.

In accordance with the embodiment depicted in FIGS. 5 and 6, only the deflector assembly of which is shown, the nonconductive deflector 100 is seen to have the same general overall shape as the deflector of the embodiment of FIGS. 1–4. More particularly, the deflector 100 has a rear surface 102 against which the particle-entrained air stream is directed in a generally axial (horizontally as viewed in FIG. 6) direction as it exits from the nozzle of the gun in a forward (leftwardly as viewed in FIG. 6) direction. The deflector 100 also includes a generally circular flat front surface 104, which if desired could be either concave or convex. Embodied in the deflector 100 and projecting radially outwardly from the periphery 106 thereof in a direction transverse to the deflected path of the powder stream are a plurality of electrode elements 108, for example, in the form of electrically conductive wires or needles. The electrode elements 108, of which there are six shown in the preferred embodiment of FIGS. 5 and 6, although a lesser or greater number can be used, are circumferentially spaced at substantially equal intervals around the periphery 106 of the deflector. Resistive circuit paths in the form of discrete radially disposed resistors 112 interconnecting each of the electrodes 108 to a central, axially disposed electrical conductor 110 which connects to a remote high voltage source (not shown). The resistors 112, which are incorporated in the body of the deflector between front and rear surfaces 104 and 102, have a resistance, in the presently preferred embodiment, of, for example, 10 Megohms, although other resistance values may be used, if desired. In accordance with a variant of the embodiment actually shown in FIGS. 5 and 6, the radially projecting electrodes 108 could be made flush with the perimeter 106 of the deflector 100, thereby avoiding the possibility of damage to the electrodes.

Figure 7:
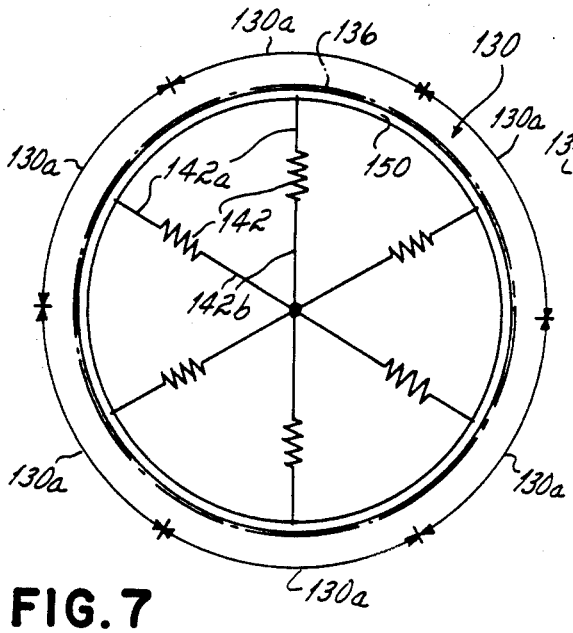
FIG. 7 is a front elevational view of a deflector, incorporating a silicon carbide ribbon or thread in the rim thereof and discrete resistors, of a still further embodiment of the invention.
Figure 8:
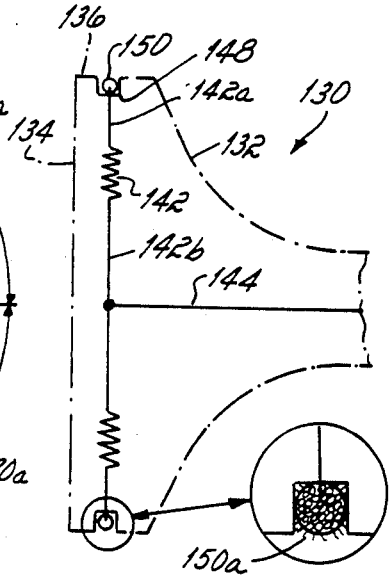
FIG. 8 is a side elevational view of the deflector of FIG. 7.

In accordance with a still further preferred embodiment of the invention depicted in FIGS. 7 and 8, of which only the deflector assembly is shown, an electrostatic spray gun is provided in which the nonconductive deflector 130 is seen to have the same overall configuration as the deflector 100 shown in the embodiment of FIGS. 5 and 6. More particularly, deflector 130 includes a front surface 134, a rear surface 132, and a perimeter 136. Like the deflector shown in FIGS. 5 and 6, the deflector 130 shown in FIGS. 7 and 8 incorporates in its body a plurality of resistive circuit paths in the form of radially disposed discrete resistors 142 which at their inner end have leads **142*b* which are connected in common to an axially disposed electrical conductor 144 which in turn is connected to a remote high voltage source (not shown). The radially outward ends of resistors 142 have leads 142*a* which terminate in a circumferential groove 148 formed in the periphery 136 of the deflector 130. Located in the groove 148 is a circumferentially-disposed silicon carbide thread or narrow ribbon 150. The radially outboard ends of resistor leads 142*a* are electrically connected with their respectively proximately located segments 130*a* of the silicon carbide thread 150. If desired, a resistive material other than silicon carbide can be used for the peripherally located ribbon or thread 150**.

In the embodiment of FIGS. 5 and 6, corona charging takes place at the radially outboard ends of the electrodes 108 past which the powder passes on its path toward the object to be coated. In the variant of the embodiment shown in FIGS. 5 and 6, wherein the electrodes 108 are flush with the perimeter 106 of the deflector 100, corona occurs at the point where the electrode joins the periphery 106 of the deflector.

In the embodiment shown in FIGS. 7 and 8, wherein a silicon carbide thread or ribbon is used, corona occurs at random locations around the surface of the thread 150. If the thread 150 is fabricated of intertwined fibers of short length relative to the circumference of the deflector perimeter 106, corona will most probably occur where the fibers terminate since the ends thereof **150*a* (see FIG. 8) function as electrodes to form corona charging points. If the silicon carbide thread does not contain short lengths of fiber with plural randomly located ends, corona will occur at randomly located points around the periphery of the silicon carbide thread 150**, the location of which points will change more or less continuously.

In the embodiment of FIGS. 7 and 8, the thread 150 in deflector groove 148 is effectively a continuous circular electrode comprised of six arcuate electrode elements or segments which are interconnected end-to-end. The continuous circular electrode 130 functions in a manner analagous to that of the periphery 46 of the disc-shaped resistive sheet 44 of FIGS. 1–4 which, in effect, at its periphery is also a continuous circular electrode comprising plural peripheral arcuate electrode elements or segments connected end-to-end.

Figure 9:
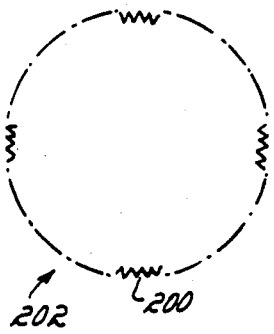
FIG. 9 is a front elevational view of a multi-point electrode in the form of a sawtooth-edged disc of uniform construction throughout.
Figure 10:
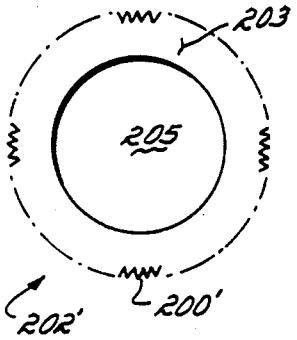
FIG. 10 is a front elevational view of a multi-point electrode in the form of a sawtooth-edged disc of composite construction.

Instead of the silicon carbide resistive fabric 44 shown in FIGS. 1–4, the multi-point electrode can take the form of a sawtooth edge 200 on the periphery of a disc 202, as shown in FIG. 9. The disc may be fabricated of the same material throughout, such as a resistive, semiconductive, or conductive material. Alternatively, the disc 202' may be a composite having an annular outer section 203 with teeth 200' at the periphery, and an inner circular section 205, as shown in FIG. 10. The inner section 205 and/or the outer section 203 may be resistive, semiconductive, or conductive.

Figure 11:
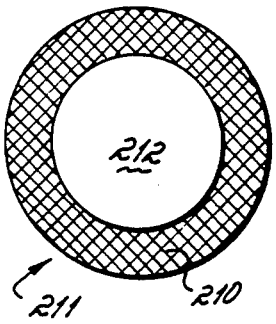
FIG. 11 is a front elevational view of a multi-point electrode in the form of a composite disc having an outer annular fabric, mesh or screen section and an inner solid circular section.

Alternatively, disc 44, instead of being entirely of silicon carbide fabric, or other resistive material, as shown in FIG. 4, could be of composite construction as shown in FIG. 11. More particularly, the resistive fabric 210 could be annular shaped, with the remainder of the disc 211 comprising an inner circular disc 212 of resistive, conductive, or semiconductive solid sheeting.

Also, instead of constructing the multi-point electrode of resistive fabric, as shown in FIG. 4, such as silicon carbide fabric, the electrode could be constructed of screen or mesh, with the strands thereof being resistive, conductive, or semiconductive wire or nonconductive wire clad with resistive, conductive, or semiconductive material.

Figure 12:
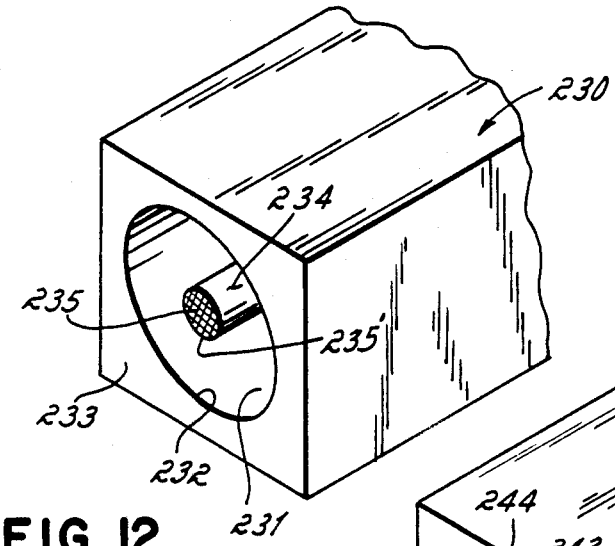
FIG. 12 is a front perspective view of the barrel of a spray device having a circular spray pattern, which uses a multi-point electrode to charge the coating particles.

FIG. 12 depicts an insulative gun barrel 230 having a longitudinal circular cross-sectional bore 231 terminating in an opening 232 in face 233 from which is emitted coating particles. Located coaxially within the bore 231 is an insulative column 234, at the outer end of which a multi-point electrode 235 is mounted. Electrode 235 may alternatively be constructed like any of the electrode configurations or structures shown in FIGS. 4–11. In the FIG. 12 embodiment, like FIGS. 4–11, electrode 235 has a peripheral edge 235' which includes multiple electrodes projecting therefrom. The electrode 235 connects to a source of electrostatic voltage via an electrical conductor (not shown) located with column 234. The device of FIG. 12 provides a circular spray pattern.

Figure 13:
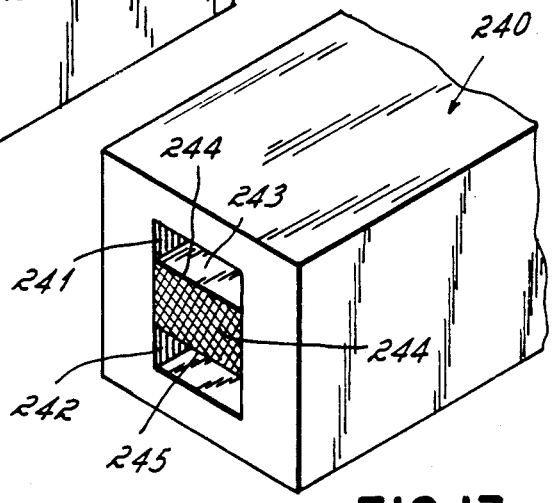
FIG. 13 is a front perspective view of the barrel of a spray device having a flat spray pattern, which uses a multi-point electrode to charge the coating particles.

FIG. 13 depicts an insulative barrel 240 having an upper rectangular cross-sectional longitudinal bore 241 and a lower rectangular cross-sectional longitudinal bore 242 separated by an insulative longitudinal column 243. Mounted on the outer end of column 243 is an electrode 244 having an upper multipoint electrode edge 244 and a lower multi-point electrode edge 245 for charging coating particles emitted from upper and lower bores 243 and 242, respectively. Electrode 244 is constructed similarly to electrode 235 of FIG. 12. The electrode 244 connects to a high voltage supply via an electrical conductor (not shown) within column 243. The embodiment of FIG. 13 provides a flat fan-shaped spray pattern.

The embodiments of FIGS. 5–13, like the embodiment of FIGS. 1–4, provide improved transfer efficiency due to the multi-point electrode configuration, and constitutes electrode assemblies which are inexpensive and simple in construction.

Figure 14:
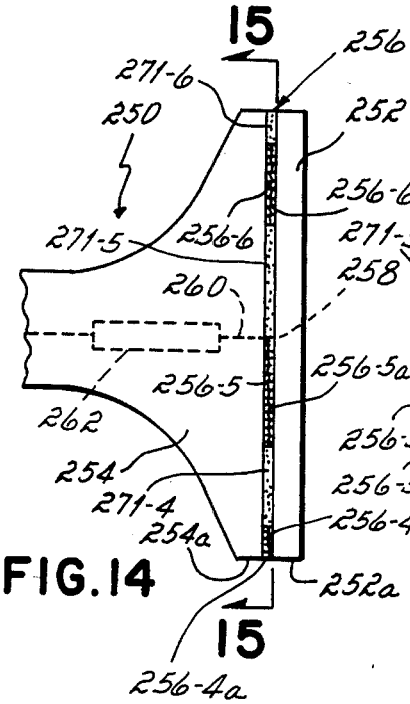
FIG. 14 is a side elevational view of a deflector incorporating a multi-point electrode having pie-shaped electrode sectors of resistive sheet material.
Figure 15:
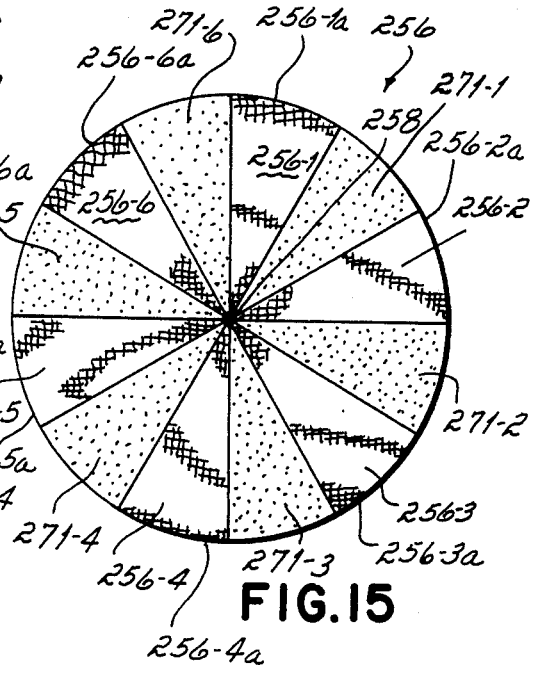
FIG. 15 is a cross-sectional view along lines 15—15 of FIG. 14.
Figure 16:
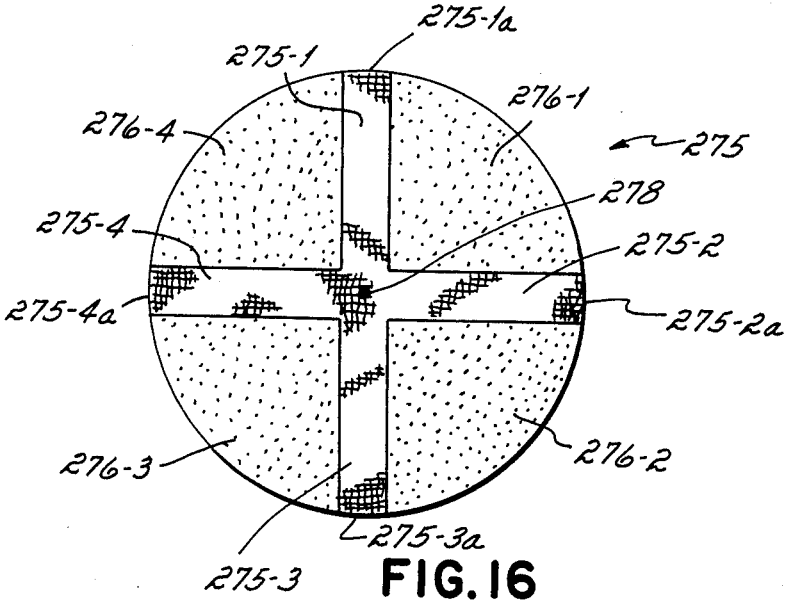
FIG. 16 is a front elevational view of a multi-point electrode incorporating rectangular-shaped resistive sheet electrode elements.

In addition to the various multi-point electrode configurations of FIGS. 4–6 and 9–11, which include circular resistive sheets, multiple discrete circumferentially-spaced radial electrodes, resistive rings, sawtooth-edged discs and annular elements, and mesh or screen constructions, other configurations can be used such as the sectored disc electrodes of FIGS. 14–16.

More particularly, and with particular reference to FIGS. 14 and 15, a deflector 250 is illustrated having a forward disc-shaped front member 252, a rear conical-shaped member 254 between which is sandwiched a multi-point electrode 256. As shown best in FIG. 15, the multi-point electrode 256 includes a plurality of triangular, or pie-shaped, sectors 256-1, . . . ,256-6 of resistive sheet material, such as silicon carbide sheet material of the type discussed in connection with FIGS. 1–4. Each of the pie-shaped sectors 256-1, . . . , 256-6 has its outer peripheral edge **256-1*a*, . . . , 256-6*a* located approximately flush with the peripheral edge 252*a* of the front element 252 and the peripheral edge region 254*a* of the rear deflector element 254. With the edges 256-1*a*, . . . , 256-6*a*** positioned as indicated, the respective edges of the resistive pie-shaped sectors will be exposed to the stream of coating material particles flowing therepast in the course of spraying an object to be coated.

Each of the pie-shaped resistive sectors 256-1, . . . , 256-6 is electrically connected at a common inner center point 258 to a central electrical conductor 260 located axially within the deflector 250 and connected at a remote point to a source of high voltage electrostatic potential (not shown). If desired, a resistor 262 shown in dotted lines may be inserted in series with the electrical conductor 260.

Interspersed between the individual pie-shaped electrode sectors 256-1, . . . , 256-6 are electrically insulating pie-shaped sectors 271-1, . . . , 271-6, preferably of insulative sheet material, which function to electrically insulate the electrode sectors from each other, at least in regions of their outer peripheral edges. The thickness of the insulative sectors 271-1, . . . , 271-6 preferably is the same as the thickness of the resistive sheet electrodes 256-1, . . . , 256-6, with the thickness being measured in a direction perpendicular to the plane of the sectors. If desired, and in lieu of insulative sheet material, the electrically insulating pie-shaped sectors 271-1, . . . , 271-6 can be air, in which case the air serves as the insulating material between the electrodes 256-1, . . . , 256-6.

In operation, and assuming the electrical conductor 260 is connected to a suitable source of high voltage electrostatic potential, each of the edges 256-1*a*, . . . , 256-6*a* of the pie-shaped sectors 256-1, . . . , 256-6 functions as an electrode for electrostatically charging coating particles, with corona discharge occurring simultaneously in the region of each of the outer edges of the pie-shaped sectors. By virtue of multiple simultaneous corona discharges in the region of the edges of 256-1*a*, . . . , 256-6*a*, the electrostatic charge transferred to the particles collectively from the plural electrode sectors 256-1, . . . , 256-6 is enhanced.

If desired, the pie-shaped sectors of resistive sheet material shown in the embodiment of FIGS. 14 and 15 can be substituted with sectors having a different configuration, such as shown in the embodiment of FIG. 16. More particularly, in the embodiment of FIG. 16, a multi-point electrode 275 is provided which includes plural radially-disposed electrode sectors 275-1, . . . , 275-4 in the form of a rectangular band or ribbon fabricated, in a preferred form, of silicon carbide resistive sheet material. Interspersed between the ribbon-shaped electrodes 275-1, . . . , 275-4, and electrically insulating them one from another, are pie-shaped insulative sheet sectors 276-1, . . . , 276-4. Collectively, the electrode sectors 275-1, . . . , 275-4 are in the form of a "cross". The outer edges 275-1*a*, . . . , 275-4*a* of electrode sectors 275-1, . . . , 275-4 are flush with the perimeter of a deflector (not shown) of the general construction shown in FIG. 14, with the interspersed electrode bands 275-1, . . . , 275-4 and pie-shaped insulative sectors 276-1, . . . , 276-4 being sandwiched between a disc-shaped front deflector element and a generally conical-shaped rear deflector element generally in accordance with the construction shown in the embodiment of FIGS. 14 and 15.

Like the multi-point electrode 256 of FIGS. 14 and 15, the multi-point electrode 275 of FIG. 16 has each of the ribbon-shaped resistive sheet electrodes 275-1, . . . , 275-4 connected at its inner end to a common electrical conductor 278 maintained at a high electrostatic charging potential during a coating operation, in much the same manner as described in connection with the embodiment of FIGS. 14 and 15. Preferably, the thickness of the band-shaped resistive sheet electrodes 275-1, . . . , 275-4 is substantially identical to the thickness of the pie-shaped insulative sheet sectors 276-1, . . . , 276-4.

In operation, and assuming the band-shaped electrode elements 275-1, . . . , 275-4 are energized by a high voltage electrostatic source, corona discharge will occur simultaneously in the region of each of the outer peripheral edges 275-1*a*, . . . , 275-4*a*, providing enhanced charge transfer to coating particles flowing therepast in the course of a spray coating operation.

While the multi-point electrodes 256 and 275 have six and four resistive electrodes, respectively, it will be understood by those skilled in the art that the specific number of electrodes can be varied, although a minimum of four is preferred. The configuration of the individual electrode sectors, which is triangular for the multi-point electrode 256, and rectangular for the multi-point electrode 275, can be modified, if desired.

From the above disclosure of the general principles of the present invention and the preceding detailed description of the preferred embodiments thereof, those skilled in the art will readily comprehend the various modifications to which the present invention is susceptible. Therefore, I desire to be limited only by the scope of the following claims and equivalents thereof.

We claim:

1. An electrostatic spray coating system comprising:

a high voltage electrostatic supply for providing electrostatic voltages;

a particle spray device having a particle spraying opening therein from which a stream of particles is sprayed in a path in a forward direction toward an article to be electrostatically coated;

a particle deflector constructed of electrically non-conductive material located in said particle path for deflecting said particle stream, said deflector having (a) a rear surface upon which said particle stream impinges and as a result thereof becomes deflected, and (b) a front surface facing in said forward direction, a resistive sheet located between said front and rear surfaces having a peripheral edge at its outer limits for effectively providing a plurality of corona charging points past which said deflected particle stream passes in its path toward said article to be coated, said resistive sheet having a high voltage terminal region located remote from said peripheral edge for establishing an electrically resistive current path through said sheet between said terminal region and said peripheral edge for the purpose of minimizing shock and ignition hazards due to inadvertent discharge of electrical energy capacitively stored in said system; and an electrical path interconnecting said high voltage supply and said terminal region of said resistive sheet to facilitate the production of corona discharges at said peripheral edge of said resistive sheet for electrostatically charging said deflected steam as it flows in proximity thereto in its path toward said article to be coated.

2. The electrostatic spray system of claim 1 wherein said rear surface is conical and wherein said resistive sheet is circular such that its peripheral edge effectively defines a circular multi-point particle-charging electrode.

3. The electrostatic spray system of claim 1 wherein said deflector has a periphery, and wherein said peripheral edge of said sheet is exposed in the region of the periphery of said deflector.

4. The electrostatic spray system of claim 1 wherein said deflector has a periphery, and wherein said peripheral edge of said sheet is substantially flush with the periphery of said deflector.

5. The electrostatic spray system of claim 1 wherein said deflector is comprised of rear and front sections, and wherein said resistive sheet is substantially flat and is sandwiched between said front and rear sections.

6. The electrostatic spray system of claim 5 wherein said deflector has a periphery, and wherein said peripheral edge of said sheet is exposed in the region of said deflector periphery.

7. The electrostatic system of claim 6 wherein said peripheral edge of said sheet is substantially flush with said deflector periphery.

8. The electrostatic system of claim 1 wherein said electrical path includes an electrical conductor projecting forwardly through said rear surface of said deflector along the axis thereof into electrical contact with said terminal region of said resistive sheet.

9. The electrostatic spray system of claim 1 wherein said resistive sheet consists substantially of fibrous resistive materials.

10. The electrostatic spray system of claim 1 wherein said resistive sheet is comprised substantially of silicon carbide filaments.

11. The electrostatic spray system of claim 1 wherein said resistive sheet comprises nonwoven fabric consisting substantially of randomly oriented silicon carbide filaments and a bonding agent.

12. An electrostatic spray coating system comprising:

a high voltage electrostatic supply for providing electrostatic voltages;

a particle spray device having a particle-spraying opening therein from which a stream of particles is sprayed in a path in a forward direction toward an article to be electrostatically coated;

a particle deflector constructed of electrically nonconductive material located in said particle path for deflecting said particle stream, said deflector having a surface upon which said particle stream impinges and as a result thereof becomes deflected;

a resistive sheet electrode having a periphery proximate said deflector surface past which said deflected particle stream passes to be electrostatically charged in its path toward said article to be coated, said resistive sheet electrode having a high voltage terminal region located remote from said periphery for establishing an electrically resistive current path from said terminal through said resistive sheet electrode to said periphery for minimizing shock and ignition hazards due to inadvertent discharge of electrical energy capacitively stored in said system; and an electrical path interconnecting said high voltage supply and said terminal region of said resistive sheet electrode to facilitate the production of a corona discharges at said electrode periphery for electrostatically charging said deflected steam as it flows in proximity thereto in its path toward said article to be coated.

13. The electrostatic spray system of claim 12 wherein said resistive sheet electrode consists substantially of silicon carbide filaments.

14. The electrostatic spray system of claim 12 wherein said resistive sheet electrode comprises fabric consisting substantially of silicon carbide filaments.

15. The electrostatic spray system of claim 12 wherein said resistive sheet electrode comprises nonwoven fabric consisting substantially of randomly oriented silicon carbide filaments and a bonding agent.

16. A particle deflector and charging assembly for use with an electrostatic spray system having a high voltage electrostatic supply for providing electrostatic voltages, and a particle spray device having a particle-spraying opening therein from which a stream of particles is sprayed in a path in a forward direction toward an article to be electrostatically coated, said particle deflector and charging assembly comprising the combination of;

a particle deflector constructed of electrically nonconductive material located in said particle path for deflecting said particle stream, said deflector having (a) a rear surface upon which said particle stream impinges and as a result thereof becomes deflected, and (b) a front surface facing in said forward direction, a resistive sheet located between said front and rear surfaces having a peripheral edge at its outer limits defining a multiple point electrode past which said deflected particle stream passes to be electrostatically charged in its path toward said article to be coated, said resistive sheet having a high voltage terminal region located remote from said peripheral edge for establishing an electrically resistive current path through said sheet between said terminal region and said peripheral edge for the purpose of minimizing shock and ignition hazards due to inadvertent discharge of electrical energy capacitively stored in said system, said terminal region being connectable to said high voltage supply to facilitate the production of a corona discharge at said peripheral edge of said sheet for electrostatically charging said deflected stream as it flows in proximity thereto in its path toward said article to be coated.

17. The particle deflector and charging assembly of claim 16 wherein said resistive sheet consists substantially of silicon carbide filaments.

18. The particle deflector and charging assembly of claim 16 wherein said resistive sheet comprises fabric consisting substantially of silicon carbide filaments.

19. The particle deflector and charging assembly of claim 16 wherein said resistive sheet comprises nonwoven fabric consisting substantially of randomly oriented silicon carbide filaments and a bonding agent.

20. An electrostatic spray coating apparatus comprising:

a particle spray device having a particle-spraying opening therein from which a stream of particles is sprayed in a path in a forward direction toward an article to be electrostatically coated;

a particle deflector constructed substantially solely of electrically nonconductive material located in said particle path for deflecting said particle stream, said deflector having a surface upon which said particle stream impinges and as a result thereof becomes deflected;

a plurality of electrode elements generally transverse said forwardly directed particle stream path, said electrode elements having electrode points proximate said deflector surface past which said deflected particle stream passes to be electrostatically charged in its path toward said article to be coated, said electrode points each being located exteriorly of said deflector surface for direct exposure to said spray opening to produce multiple simultaneous corona discharges when electrostatically energized from a high voltage source, said electrode elements, including said electrode points, not extending substantially into said opening, an electrical terminal associated with said deflector which is connectable to a source of high voltage, said terminal being remotely located relative to said plurality of electrode elements, and a plurality of resistive circuit paths incorporated in said deflector which are each connected between said terminal and a different one of said plurality of electrode elements, said resistive paths facilitating both energization of said electrode elements to produce said multiple simultaneous corona discharges at said electrode points when said terminal is connected to a high voltage source and minimizing shock and ignition hazards due to inadvertent discharge of electrical energy capacitively stored in said spray coating apparatus.

21. The apparatus of claim 20 wherein said electrode elements are each discrete electrical conductors located in substantially a single plane and having an outer pointed end constituting one of said electrode points extending outwardly from said deflector exteriorly of said deflector surface in a direction transversely to said deflected particle stream and an inner end connected to a different one of said resistive circuit path.

22. The apparatus of claim 20 wherein each said electrode element is a discrete electrical conductor incorporated in said deflector having an outer pointed end terminating proximate and exteriorly of said deflector surface consisting one of said electrode points and an inner end connected to a different one of said resistive paths, said electrode elements being located in substantially a single plane.

23. The apparatus of claim 20 wherein said plurality of electrode elements collectively comprise serially connected segments of a single continuous electrode mounted to said deflector generally parallel to said deflector surface and transverse to said deflected particle stream, and wherein each of said resistive paths connect to a different one of said segments.

24. The apparatus of claim 23 wherein said continuous electrode consists substantially of a fibrous resistive material.

25. The apparatus of claim 24 wherein said fibrous resistive material comprises silicon carbide filaments.

26. The apparatus of claim 20 wherein said resistive circuit paths each comprises a discrete resistor.

27. The apparatus of claim 21 wherein said resistive circuit paths each comprises a discrete resistor.

28. The apparatus of claim 22 wherein said resistive circuit paths each comprises a discrete resistor.

29. The apparatus of claim 23 wherein said resistive circuit paths each comprises a discrete resistor.

30. The apparatus of claim 24 wherein said resistive circuit paths each comprises a discrete resistor.

31. The apparatus of claim 24 wherein said fibrous resistive material includes filaments having ends projecting outwardly therefrom whereat corona can occur when said continuous fibrous resistive electrode is energized from a high voltage source via said resistive circuit paths.

32. The apparatus of claim 25 wherein said fibrous resistive material includes filaments having ends projecting outwardly therefrom whereat corona can occur when said continuous fibrous resistive electrode is energized from a high voltage source via said resistive circuit paths.

33. The electrostatic spray system of claim 9 wherein said fibrous resistive sheet includes filaments having ends projecting outwardly therefrom at the periphery of said sheet whereat said corona discharges occur.

34. The electrostatic spray system of claim 10 wherein said silicon carbide filaments include ends projecting outwardly therefrom at the periphery of said sheet whereat said corona discharges occur.

35. The system of claim 13 wherein said silicon carbide filaments include ends projecting outwardly therefrom at the periphery of said sheet whereat said corona discharges occur.

36. The assembly of claim 17 wherein said silicon carbide filaments include ends projecting outwardly therefrom at the periphery of said sheet whereat said corona discharges occur.

37. The electrostatic spray system of claim 1 wherein said resistive sheet comprises woven silicon carbide filaments.

38. The electrostatic spray system of claim 1 wherein said resistive sheet comprises woven resistive filaments.

39. The system of claim 1 wherein said spray device includes (a) an electrically nonconductive barrel having a nozzle in which said particle spraying opening is located and (b) an electrically conductive section located remote from said nozzle;

means connected to said electrically conductive section of said spray device for maintaining said electrically conductive section at an electrostatic voltage substantially different than the voltage of said corona charging points or at ground potential, and an electrostatic shield located between said corona charging points and said electrically conductive section to electrostatically shield electrostatically charged particles in the region of said nozzle from said electrically conductive section.

40. The system of claim 39 wherein said electrostatic shield is incorporated in said nozzle.

41. The system of claim 39 wherein said nozzle is outwardly and forwardly flared to provide, in the region of said charged particles proximate said particle-spraying opening, a portion thereof which is located outwardly and rearwardly of said corona charging points, thereby defining said electrostatic shield.

42. The system of claim 12 wherein said spray device includes (a) an electrically nonconductive barrel having a nozzle in which said particle spraying opening is located and (b) an electrically conductive section located remote from said nozzle, means connected to said electrically conductive section of said spray device for maintaining said electrically conductive section at an electrostatic voltage substantially different than the voltage of said electrode periphery or at ground potential, and an electrostatic shield located between said electrode periphery and said electrically conductive section to electrostatically shield electrostatically charged particles in the region of said nozzle from said electrically conductive section.

43. The system of claim 42 wherein said electrostatic shield is incorporated in said nozzle.

44. The system of claim 42 wherein said nozzle is outwardly and forwardly flared to provide, in the region of said charged particles proximate said particle-spraying opening, a portion thereof which is located outwardly and rearwardly of said electrode periphery, thereby defining said electrostatic shield.

45. The apparatus of claim 20 wherein said spray device includes (a) an electrically nonconductive barrel having a nozzle in which said particle spraying opening is located and (b) an electrically conductive section located remote from said nozzle, means connected to said electrically conductive section of said spray device for maintaining said electrically conductive section at an electrostatic voltage substantially different than the voltage of said electrode points or at ground potential, and an electrostatic shield means substantially solely of nonconductive material located between said electrode points and said electrically conductive section for electrostatically shielding electrostatically charged particles in the region of said nozzle from said electrically conductive section and for inhibiting parasitic flow of charge from said electrode elements.

46. The apparatus of claim 45 wherein said electrostatic shield is incorporated in said nozzle.

47. The apparatus of claim 45 wherein said nozzle is outwardly and forwardly flared to provide, in the region of said charged coating proximate said particle-spraying opening, a portion thereof which is located outwardly and rearwardly of said electrode elements, thereby defining said electrostatic shield.

48. An electrostatic spray coating apparatus comprising:

a particle spray device having a particle-spraying opening therein from which a stream of particles is sprayed in a path in a forward direction toward an article to be electrostatically coated;

a multipoint electrode comprising a substantial number of closely spaced electrode elements located generally transverse of said forwardly directed particle stream path and having electrode points in direct exposure to said opening, said electrode elements, including said electrode points, not extending significantly into said opening through which said particle stream passes to be electrostatically charged in its path toward said article to be coated, said electrode elements being connectable to an electrostatic voltage source for establishing a plurality of simultaneous corona discharges at said corona charging points to enhance transfer efficiency.

49. The apparatus of claim 48 wherein the multipoint electrode includes silicon carbide fabric having a peripheral edge defining said plurality of spaced electrode points.

50. The apparatus of claim 48 wherein the multipoint electrode includes resistive sheet located in substantially a single plane and having a peripheral edge defining said substantial number of closely spaced electrode points directly exposed to said opening.

51. The apparatus of claim 48 wherein the multipoint electrode includes mesh having a peripheral edge defining said substantial number of closely spaced electrode points.

52. The apparatus of claim 51 wherein the mesh is resistive.

53. The apparatus of claim 48 wherein the multipoint electrode includes a sheet having a toothed peripheral edge defining said substantial number of closely spaced electrode points.

54. The apparatus of claim 53 wherein said sheet is a composite including (a) an outer section on which said teeth are formed, and (b) an inner section connectable to a source of high voltage which is more electrically resistive than said outer section.

55. The apparatus of claim 48 wherein the multipoint electrode includes a semiconductive sheet located in substantially a single plane and having a peripheral edge defining said substantial number of closely spaced electrode points directly exposed to said opening.

56. The system of claim 1 wherein said spray device includes (a) an electrically nonconductive barrel having a nozzle in which said particle spraying opening is located and (b) a rear section located remote from said nozzle; and an electrostatic shield extending laterally beyond and rearwardly of said corona charging points to electrostatically shield electrostatically charged particles in the region of said nozzle from sources of electrostatic potential different from that of said electrode located rearwardly and/or laterally relative to said corona charging points.

57. The system of claim 56 wherein said electrostatic shield is incorporated in said nozzle.

58. The system of claim 56 wherein said nozzle is outwardly and forwardly flared to provide, in the region of said charged particles proximate said particle-spraying opening, a portion thereof which is located outwardly and rearwardly of said corona charging points, thereby defining said electrostatic shield.

59. The system of claim 12 wherein said spray device includes (a) an electrically nonconductive barrel having a nozzle in which said particle spraying opening is located and (b) a rear section located remote from said nozzle, and an electrostatic shield extending laterally beyond and rearwardly of said electrode periphery to electrostatically shield electrostatically charged particles in the region of said nozzle from sources of electrostatic potential different from that of said electrode located rearwardly and/or laterally of said electrode periphery.

60. The system of claim 59 wherein said electrostatic shield is incorporated in said nozzle.

61. The system of claim 59 wherein said nozzle is outwardly and forwardly flared to provide, in the region of said charged particles proximate said particle-spraying opening, a portion thereof which is located outwardly and rearwardly of said electrode periphery, thereby defining said electrostatic shield.

62. The apparatus of claim 20 wherein said spray device includes (a) an electrically nonconductive barrel having a nozzle in which said particle spraying opening is located and (b) a rear section located remote from said nozzle, and an electrostatic shield substantially solely of nonconductive material extending laterally beyond and rearwardly of said corona charging electrode points for electrostatically shielding electrostatically charged particles in the region of said nozzle from sources of electrostatic potential different from that of said electrode points located rearwardly and/or laterally relative to said electrode points and for inhibiting parasitic flow of charge from said electrode elements.

63. The apparatus of claim 62 wherein said electrostatic shield is incorporated in said nozzle.

64. The apparatus of claim 62 wherein said nozzle is outwardly and forwardly flared to provide, in the region of said charged coating proximate said particle-spraying opening, a portion thereof which is located outwardly and rearwardly of said electrode points, thereby defining said electrostatic shield.

65. The apparatus of claim 48 wherein said multipoint electrode is an electrically conductive sheet located in substantially single plane and having a peripheral edge defining said substantial number of closely spaced electrode points.

66. An electrostatic spray coating system comprising:

a high voltage electrostatic supply for providing electrostatic voltages;

a particle spray device having a particle-spraying opening therein from which a stream of particles is sprayed in a path in a forward direction toward an article to be electrostatically coated;

a particle deflector constructed of electrically non-conductive material located in said particle path for deflecting said particle stream, said deflector having a surface upon which said particle stream impinges and as a result thereof becomes deflected;

a conductive sheet electrode having a periphery proximate said deflector surface past which said deflected particle stream passes to be electrostatically charged in its path toward said article to be coated, said conductive sheet electrode also having a high voltage terminal region located remote from said periphery, the portion of said conductive sheet electrode disposed between said terminal and said periphery establishing electrical current paths from said terminal through said sheet electrode to said periphery;

an electrical path interconnecting said high voltage supply and said terminal region of said conductive sheet electrode to facilitate the production of a plurality of corona discharges at said electrode periphery for electrostatically charging said deflected stream as it flows in proximity thereto in its path toward said article to be coated.

67. An electrostatic spray coating apparatus comprising:

a particle spray device having a particle-spraying opening therein from which a stream of particles is sprayed in a path in a forward direction toward an article to be electrostatically coated;

a particle deflector constructed of electrically non-conductive material located in said particle path for deflecting said particle stream, said deflector having a surface upon which said particle stream impinges and as a result thereof becomes deflected;

a plurality of electrode elements in substantially a single plane generally transverse said forwardly directed particle stream path, said electrode elements directly exposed to said opening and proximate said deflector surface past which said deflected particle stream passes to be electrostatically charged in its path toward said article to be coated by multiple corona points at said electrodes when said electrodes are energized from a high voltage electrostatic source;

an electrical terminal associated with said deflector which is connectable to a source of high voltage, said terminal being remotely located relative to said plurality of electrode elements, and a sheet incorporated in said deflector defining a plurality of circuit paths which are each connected between said terminal and a different one of said plurality of electrode elements, said paths facilitating energization of said electrode elements to create at each of said electrode elements corona discharges when said terminal is connected to a high voltage source.

68. An electrostatic spray coating apparatus comprising:

a particle spray device having a particle-spraying opening therein form which a stream of particles is sprayed in a path in a forward direction toward an article to be electrostatically coated;

a particle deflector constructed of electrically non-conductive material located in said particle path for deflecting said particle stream, said deflector having a surface upon which said particle stream impinges and as a result thereof becomes deflected;

a plurality of electrode elements in substantially a single plane generally transverse said forwardly directed particle stream path, said electrode elements directly exposed to said opening and proximate said deflector surface past which said deflected particle stream passes to be electrostatically charged in its path toward said article to be coated by multiple corona points at said electrodes when said electrodes are energized from a high voltage electrostatic source;

an electrical terminal associated with said deflector which is connectable to a source of high voltage, said terminal being remotely located relative to said plurality of electrode elements, and a plurality of circuit paths which each include sheet material, said circuit paths each being incorporated in said deflector, and connected between said terminal and a different one of said plurality of electrode elements for facilitating energization of said electrode elements to create at each of said electrode elements corona discharges when said terminal is connected to a high voltage source.

69. The system of claim 1 wherein said resistive sheet comprises plural circumferentially-spaced resistive sectors each having a peripheral edge segment susceptive of being one of said plurality of corona points and a radially inner end, said peripheral edge segments collectively comprising said peripheral edge of said resistive sheet to render said peripheral edge discontinuous, said inner ends of said resistive sectors being connected to said high voltage terminal region, said system further comprising means for insulating said circumferentially-spaced resistive sectors to electrically insulate said resistive sectors from each other at least in the region of said peripheral edge segments to facilitate simultaneous generation of corona points at plural peripheral edge segments when said terminal region is energized by said high voltage electrostatic supply.

70. The system of claim 69 wherein said resistive sectors are generally pie-shaped with their respective inner ends disposed centrally of said resistive sheet and collectively constituting said high voltage terminal region.

71. The system of claim 70 wherein said insulative means are generally pie-shaped and disposed between said pie-shaped resistive sectors.

72. The system of claim 71 wherein said pie-shaped insulative means are fabricated of sheet material, said pie-shaped insulative sheet means and said pie-shaped resistive sheet sectors collectively defining a generally circular array of alternating resistive sectors and insulative means.

73. The system of claim 12 wherein said resistive sheet comprises plural circumferentially-spaced sectors each having a peripheral edge segment susceptive of being one of said plurality of corona points and a radially inner end, said peripheral edge segments collectively comprising said periphery of said resistive sheet to render said periphery discontinuous, said inner ends of said sectors being connected to said high voltage terminal region, said system further comprising insulative means located between said circumferentially-spaced resistive sectors to electrically insulate said resistive sectors from each other at least in the region of said peripheral edge segments to facilitate simultaneous generation of corona points at plural peripheral edge segments when said terminal region is energized by said high voltage electrostatic supply.

74. The system of claim 73 wherein said resistive sectors are generally pie-shaped with their respective inner ends disposed centrally of said resistive sheet and collectively constituting said high voltage terminal region.

75. The system of claim 74 wherein said insulative means are generally pie-shaped and disposed between said pie-shaped resistive sectors.

76. The system of claim 75 wherein said pie-shaped insulative means are fabricated of sheet material, said pie-shaped insulative sheet means and said pie-shaped resistive sheet sectors collectively defining a generally circular array of alternating resistive sectors and insulative means.

77. A particle deflector and charging assembly for use with an electrostatic spray system having a high voltage electrostatic supply for providing electrostatic voltages, and a particle spray device having a particle-spraying opening therein from which a stream of particles is sprayed in a path in a forward direction toward an article to be electrostatically coated, said particle deflector and charging assembly comprising the combination of;

a particle deflector constructed of electrically non-conductive material located in said particle path for deflecting said particle stream, said deflector having (a) a rear surface upon which said particle stream impinges and as a result thereof becomes deflected, and (b) a front surface facing in said forward direction, a plurality of circumferentially-spaced sectors of resistive sheet material located between the front and rear surfaces of the deflector and each having a peripheral edge segment susceptive of being a corona point and a radially inner end, said peripheral edge segments collectively comprising a discontinuous peripheral edge containing plural corona points located proximate said stream of particles, said inner ends of said sectors being connectable to a high voltage source, insulative means located between said circumferentially-spaced resistive sectors to electrically insulate said resistive sectors from each other at least in the region of said peripheral edge segments to facilitate simultaneous generation of corona points at plural peripheral edge segments when said inner ends are energized by a high voltage electrostatic source.

78. The assembly of claim 77 wherein said resistive sectors are generally pie-shaped with their respective inner ends disposed centrally of said resistive sheet and collectively constituting a high voltage terminal region connectable to a high voltage source.

79. The assembly of claim 78 wherein said insulative means are generally pie-shaped and disposed between said pie-shaped resistive sectors.

80. The assembly of claim 79 wherein said pie-shaped insulative means are fabricated of sheet material, said pie-shaped insulative sheet means and said pie-shaped resistive sheet sectors collectively defining a generally circular array of alternating resistive sectors and insulative means.

81. The apparatus of claim 20 wherein the electrode elements are located in substantially a single plane.

82. The apparatus of claim 48 wherein the electrode elements are located in substantially a single plane.

* * * * *